United States Patent [19]

Schefer et al.

[11] 4,309,000

[45] Jan. 5, 1982

[54] DOFFER MECHANISMS

[75] Inventors: Kurt Schefer; Peter Flueckiger, both of Winterthur, Switzerland

[73] Assignee: Rieter Machine Works, Ltd., Winterthur, Switzerland

[21] Appl. No.: 68,747

[22] Filed: Aug. 23, 1979

[51] Int. Cl.[3] ..... B65H 54/20; B65H 67/04

[52] U.S. Cl. ..... 242/18 A; 242/35.5 A; 242/41; 242/79

[58] Field of Search ..... 242/18 A, 18 DD, 18 R, 242/35.5 A, 41, 79, 81

[56] References Cited

U.S. PATENT DOCUMENTS

| | | | |
|---|---|---|---|
| 2,281,423 | 4/1942 | Egge | 242/79 |
| 2,430,075 | 11/1947 | Olson | 242/79 |
| 2,911,164 | 11/1959 | Caine | 242/79 |
| 3,077,317 | 2/1963 | Angst | 242/79 |
| 3,438,593 | 4/1969 | Reed | 242/79 |
| 4,007,884 | 2/1977 | Schippers et al. | 242/18 A X |
| 4,055,313 | 10/1977 | Yamaguchi et al. | 242/79 X |

FOREIGN PATENT DOCUMENTS

| | | | |
|---|---|---|---|
| 1940426 | 3/1970 | Fed. Rep. of Germany | 242/79 |

*Primary Examiner*—Stanley N. Gilreath
*Attorney, Agent, or Firm*—Kenyon & Kenyon

[57] ABSTRACT

The doffing system employs a doffing carriage which is reciprocable along rails to receive and carry bobbin packages away from the chucks of a winder. The carriage is constructed with a parallelogram linkage so as to have an upper frame portion raised and lowered while remaining horizontal in order to carry a bobbin package.

7 Claims, 4 Drawing Figures

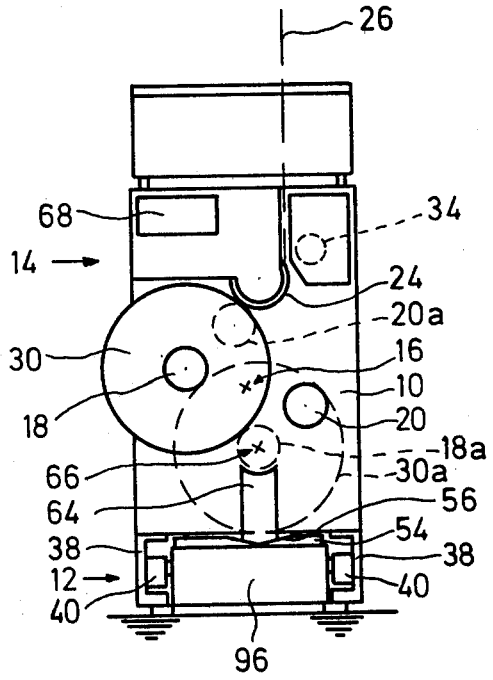
Fig. 1
Fig. 2
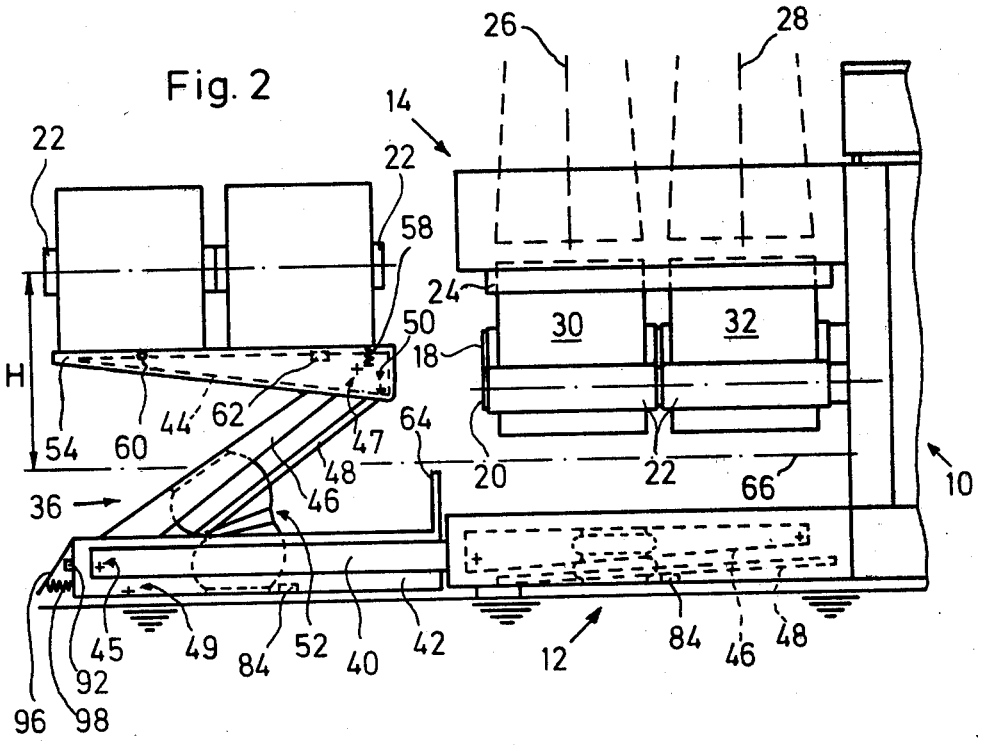

DOFFER MECHANISMS

The present invention is concerned with doffer mechanisms, particularly but not exclusively for use with winding apparatus winding synthetic filament. The term "filament" in this specification includes both mono-filamentary and multi-filamentary material.

PRIOR ART

Filament winding apparatus commonly comprise a rotatable chuck adapted to releasably hold a bobbin upon which filament can be wound as the chuck is rotated. The modern trend towards higher filament production rates necessitates not only faster rotation rates for the chuck but also quicker transfer of the continuously moving filament from a full package to a fresh bobbin. Thus, bobbin revolvers have become common in which at least two chucks are mounted cantilever-fashion on a rotatable head so that the chucks can be brought alternately and automatically into a winding position by rotation of the head, thereby enabling fast and automatic transfer of a filament from a full package on one chuck leaving the winding position to an empty bobbin on the other chuck moving into that position (see for example Published European Patent Application No. 1359/79).

Much attention has also been given to the doffing/-donning problem, that is the removal of a full package from a revolver chuck and its replacement by an empty bobbin. This must also be effected speedily, otherwise the full package may interfere with the buildup of filament on the new bobbin in the winding position. Since it is not possible to guarantee that an operator can always be present at exactly the right time to remove a full package from the chuck, fully automatic doffing and handling systems have been developed for bobbin revolvers. However, aside from the substantial capital cost involved in such complex systems, they bring an array of operating and maintenance problems. Thus, there remains a demand for relatively simple systems which are dependent upon operator attendance and in particular upon handling of packages by the operator after they have been doffed automatically.

Doffing mechanism of this relatively simple type have already been described in several patents including U.S. Pat. No. 4,007,884. There, bobbins are pushed off a chuck onto a receiver cradle which is movable between a retracted position, in which it is located under the chuck in the doffing position, and an extended position in which it holds doffed bobbins in positions in front of the winding machine and presents them for removal by an operator. There are two problems with this type of mechanism.

Firstly, during doffing the receiver cradle is fixed in height relative to the machine frame and a gap must be left between the packages and the cradle when the packages are still located on the chuck because otherwise there is a risk of interference by the cradle with the movement of the chuck carrier head. Thus, the packages must drop from the chuck to the cradle, and inevitably the first contact between a package and the cradle is at the package edge, which can be damaged thereby. A partial solution to this problem is contained in the relatively complex system shown in Japanese Pat. No. 51-75146, where a doffing carriage providing one element of a fully automatic system has a raisable and lowerable doffing head. However, this head is designed to co-operate with the bobbin rather than the package. This requires a special bobbin structure. It is also highly inconvenient when more than one package is to be provided on a single chuck.

A second problem in all relatively simple systems is the normal height of the doffing position relative to the operator's ground level. The doffing position is normally at or about the lowest position of the chuck in the movement cycle determined by the revolver head. Further, the axis of revolution of the head itself is usually placed as low as possible in the machine frame, both to keep the overall centre of gravity of the machine as low as possible and to leave space in the upper portion of the frame for the guide systems which must receive the filament from the spinneret and for the manual controls which should be at a convenient working height for the operator. This means, however, that the operator is forced to bend in order to lift the doffed packages for removal from the working area around the machine. Bending is a well known workplace hazard, and becomes an increasing problem in the filament winding field with the current tendency towards increasingly heavy packages on the individual winding chucks. Filament producers have therefore demanded a "package lift" to raise doffed packages to a convenient working height for a machine operator.

PRESENT INVENTION

It is a general object of the present invention to provide in an operator attended winding machine an improved automatic doffing system which (a) reduces the risk of damage to the packages, and (b) enables the machine designer to ensure both that packages are presented to an operator at a convenient working height relative to the operator's ground level even when the doffing position of the winding machine is low relative to that ground level, and that the doffing system operates without undue interference with the service area, usually in the form of a gangway, normally provided in front of operator-attended winding machines.

According to the invention, a doffing carriage for use during doffing of filament packages from a chuck of a filament winding machine comprises a raisable and lowerable portion (hereinafter "raisable portion") adapted to receive and support doffed packages by contact with the filament windings thereof, operating means for raising and lowering said portion and sensor means for sensing contact of said portion with a package while the latter is on said chuck, the operating means being responsive to the sensor means to cease raising said portion when said sensor means senses contact of the portion with a package on the chuck.

Thus the carriage may be made movable in the machine frame between a retracted position in which it lies beneath the chuck when the latter carries a full package, said portion then being lowered, and an extended position in which it is located in front of the machine frame. In use, the carriage will normally be located in a service gangway in front of the machine when it is in its extended position.

The winding machine may be a bobbin revolver having a doffing position which, considered with reference to an operator attendant, is low relative to a support surface on which the machine stands and which provides the operator's ground level. This portion may therefore be raisable after completion of doffing of the package to raise it to a convenient working height for an attendant.

The actual doffing means, adapted to engage a package and move it off the chuck, may be provided on said carriage or may be seperate therefrom.

The raisable portion may comprise a package receiver and a support therefor, the receiver being mounted on the support for limited movement thereon between a first position in which the sensor is not operated and a second position in which the sensor is operated, the receiver being biased towards a first position and being moved towards a second position following engagement with an obstruction during raising of the raisable portion. The sensor may be a contact type sensor, for example a switch.

The operating means may comprise a linkage pivotally connected to the raisable portion and means for pivoting the linkage to raise and lower the portion. The linkage is preferably of the parallel type so that the portion maintains substantially the same disposition throughout the raising and lowering movement. The means for pivoting the linkage may be pressure fluid operated, preferably pneumatically operated, and preferably comprises a member which is both extensible and transversely flexible, e.g. a fluid expandable envelope.

The carriage may be adapted to run in a track disposed on either side thereof. The track may comprise a first part fixedly located beneath the chuck and a second part extensible from the first part into the area in front of the machine during doffing of a package, the carriage being supported by the second track part. The second track part may comprise a pair of rail members disposed on either side of the carriage.

Movement of the carriage longitudinally of the chuck during doffing may also be effected by pressure fluid operated means. The fluid operated means causing raising and lowering of the raisable portion and the fluid operating means causing movement of the carriage along the chuck may be linked by a single control circuit such that the achievement of a predetermined condition of one of the fluid operated means (or of the parts operated thereby) triggers a subsequent operation of the other fluid operated means. However, the automatic cycle of operations controlled by the circuit may be broken when a package is suitably presented to an attendant, so that production of a signal initiating return of the carriage is dependent upon a manual operation.

BRIEF DESCRIPTION OF THE DRAWINGS

By way of example one embodiment of the invention will now be described with reference to the accompanying diagrammatic drawings, in which:

FIG. 1 is a front elevation of a bobbin revolver in accordance with the invention, FIG. 2 is a side elevation of the same machine.

DETAILED DESCRIPTION OF THE INVENTION

Figure 3:
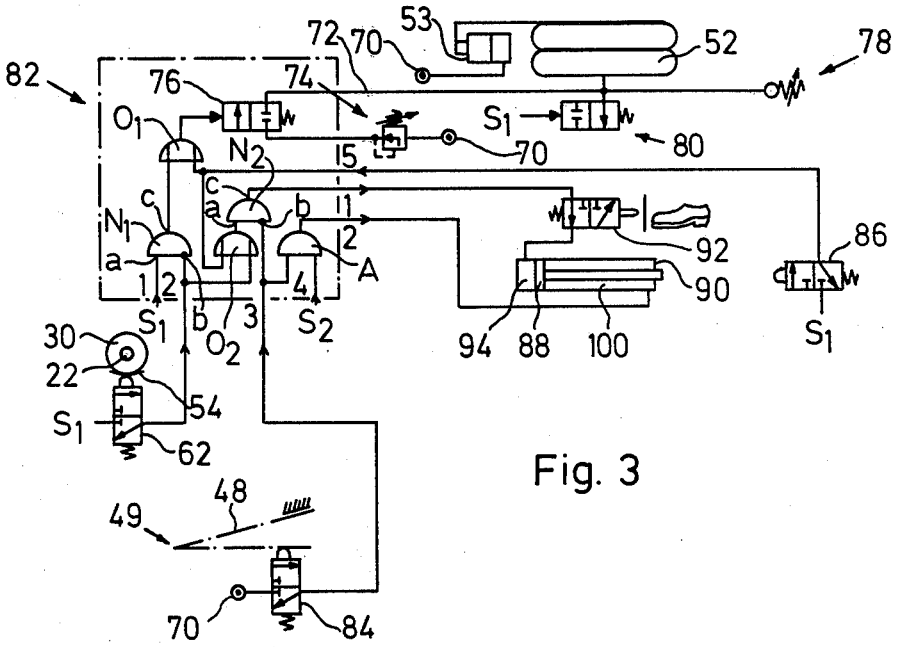
FIG. 3 is a circuit diagram of a pneumatic control system incorporated in the machine of FIGS. 1 and 2.

The revolver or winding machine shown in FIGS. 1 and 2 comprises a main frame portion 10, a base 12, and a canopy section 14. The main frame portion 10 houses the various drive and bearing units of the revolver. Since these are not important to the present invention they are not illustrated. They include a carrier head rotatable about the axis 16 and carrying two chucks 18,20 respectively which project cantilever-fashion from the carrier head into a working zone between the canopy section 14 and the base 12. The carrier head is rotatable in an anticlockwise direction as viewed in FIG. 1 to bring the chucks 18, 20 successively into a winding position in which bobbin tubes 22 (FIG. 2) carried by each chuck in use will engage a friction drive roller 24. Drive roller 24 is mounted in the main frame portion 10 and is driven into rotation about its own longitudinal axis. Each chuck 18,20 is also rotatable about its own longitudinal axis, and is driven into such rotation by reason of the contact between its bobbin tube 22 and the drive roller 24. Two filaments 26, 28 respectively come from a spinneret and are lead around the drive roller 24 onto respective bobbin tubes 22. In passing through the canopy section 14, the filaments are engaged by a traverse mechanism 34 which produces a reciprocating movement of each filament longitudinally of the drive roller axis, so that the filaments are wound onto their respective bobbin tubes in cross wound packages 30, 32 respectively.

FIGS. 1 and 2 illustrate the revolver at the stage of its operating cycle at which winding of the packages 30, 32 on the chuck 18 is complete. It will be noticed that the carrier head (not shown) has rotated to move the chuck 18 away from the drive roller 24 to allow build up of the packages between the chuck and the roller, the drive contact now being between the roller and packages instead of direct on the bobbin tubes. Immediately after this stage the carrier head is rotated relatively rapidly in a counter clockwise direction to move the chuck 18 to the doffing position indicated in dotted lines at 18*a* and to move the chuck 20 into the initial winding position indicated in dotted lines at 20*a*. During this interchange stage of the winder cycle, the filaments 26, 28 are take up automatically by the chuck 20 and are severed to separate the full packages on the chuck 18 from the newly forming packages on the chuck 20. The full packages at the doffing position must now be removed as soon as possible from the working zone of the revolver otherwise they will interfere with the build up of packages on the chuck 20.

In order to ensure that the packages on chuck 18 are removed quickly enough, the machine includes an automatically operating doffing carriage 36 (FIG. 2) which is built into base 12 and runs in guide tracks formed on the inside of the side walls 38 (FIG. 1) of the base 12. Mounted in the guide tracks are guide rails 40 which are reciprocable between retracted positions in which they lie wholly within the base 12 of the machine and extended positions in which they extend forwardly of base 12 as shown in the lefthand half of FIG. 2. Carriage 36 is also reciprocable along with the rails 40 via a moving means between a retracted position in which it lies wholly within the base 12 beneath the chuck 18 and an extended position in which it is spaced from the chuck 18 and located in the service area in front of the winding machine being supported at this time by the extended rails 40.

Carriage 36 comprises a lower frame portion 42 (FIG. 2), an upper frame portion 44 and a parallelogram linkage comprising a lever 46 pivoted to the lower frame portion at 45 and to the upper frame portion at 47, and a second lever 48 pivoted to the lower frame portion at 49 and to the upper frame portion at 50. This parallelogram linkage functions as part of a moving means for raising and lowering the upper frame portion 44 relative to the lower frame portion 42 while maintaining the upper frame portion 44 in a horizontal disposition parallel to the lower frame portion. Raising and lowering of the upper frame portion 44 can be effected by pivoting the lever 46 by means of an expandable air bag 52 the operation of which will be described further below and which forms a further part of the moving means.

Upper frame portion 44 carries a package receiving member or plate 54 which has a depression 56 (FIG. 1) lying directly underneath the packages when they are in the doffing position. Plate 54 is pivoted to frame portion 44 by pivot mounting 60 (FIG. 2). The plate is biased in an anticlockwise direction as viewed in FIG. 2 by spring 58 and, in the absence of any packages on the plate 54, the plate will be pushed by the spring 60 against a suitable stop (not shown) such that the rear end of the plate is clear of the micro-switch 62 mounted near the rear end of the upper frame portion 44. However, when the plate 54 is raised against the packages, the plate 54 is pivoted in a clockwise direction around the pivot 60 so that its rear end engages and operates a micro-switch 62 which functions as a sensor means for sensing contact of the plate 54 with a package. The result of this operation will be described later with reference to the control system shown in FIG. 3.

The lower frame portion 42 also carries a doffer plate 64 extending upwardly from the rear portion thereof and formed at its upper end with a semi circular cut out to enable the plate to partially encircle a chuck in the doffing position and to engage behind the inboard bobbin tube 22 thereof. Although not shown in FIGS. 1 and 2, the main frame portion 10 also includes a pneumatically operated doffing cylinder, the piston of which is secured to the lower frame portion 42 of the carriage. The doffing cylinder is horizontally reciprocable and is double acting so that it can drive the carriage, and therefore the rails, between the extended and the retracted positions during the doffing operation, which will now be described.

During most of the winding cycle, the carriage lies in the fully retracted position indicated with dotted lines in FIG. 2 and shown in full lines in FIG. 1. That is, the upper frame portion 44 of the carriage is in its lowermost position and the carriage itself is wholly withdrawn into the base structure 12. Thus, the front of the winding machine is unobstructed for access by service personnel, and the working area of the machine between the canopy section 14 and the base 12 is also unobstructed to enable free build-up of packages and free movement of the carrier head. Accordingly when chuck 18 lies in the doffing position, represented by the chain dotted lines in FIG. 1, the packages will lie above the receiver plate 54 on the carriage.

The arrival of the chuck at the doffing position is registered automatically in a winding cycle control system built into the structure of the winder. This winder control system causes braking of the chuck and then release of the clamping mechanism which holds the bobbin tubes 22 on the chuck structure for rotation therewith. The winder control also supplies an initiating signal to the doffing control circuit shown in FIG. 3. The circuit itself will be described below. It controls the following movements of the carriage which occur during a normal doffing operation.

Firstly, the levers 46, 48 are pivoted in an anticlockwise direction (as viewed in FIG. 2) about their lower pivots 45, 49 so as to raise the upper frame portion 44 until the plate 54 contacts the packages and is pivoted to operate the micro-switch 62. Operation of the micro-switch 62 halts pressurisation of the bag 52, but the existing pressure in the bag is maintained to hold the plate 54 against the under side of the packages.

The main doffing cylinder in housing 10 is now operated to move the carriage 36 outwardly of the machine into the service gangway. In the course of this motion, the doffer plate 64 engages the inboard bobbin tube 22 and urges both tubes off the chuck 18. There is no significant drop for a package as its bobbin tube leaves the outboard end of the chuck, because contact between the receiver plate 54 and the underside of the packages is maintained throughout the doffing movement. However, there is no tendency for the carriage to jam the tubes against the underside of the chuck because the doffing control system merely maintains the existing pressure inside the bag 52 without further pressurisation urging the frame portion 44 upwards.

As the full weight of the outboard package 30 is taken by the carriage 36, the upper frame portion 44 may be depressed slightly. However, the spring 58 will then pivot the plate 54 anticlockwise so that switch 62 is no longer operated because the weight of this first package falls directly on the mounting 60. Operation of switch 62 will cause the outward movement of the carriage to stop, further raising of the frame portion 44 to bring the plate 54 once again into contact with the inboard package 32, termination of raising of the frame portion 44 and continued outward movement of the carriage 36. When the carriage is fully extended the upper frame portion 44 and the packages carried thereby will be clear of the front of the winding machine. The packages will rest in the depression 56 in the plate 54, and their longitudinal axes will be roughly coaxial with the axis 66 of the chuck in the doffing position. The full extension of the carriage will be registered by the doffing control system which will thereupon initiate further raising of the frame portion 44 to move the package axis through the distance H shown in FIG. 2. In the raised position of the frame portion 44, the packages are presented at a convenient working height for an operator to remove then from the carriage without having to bend in order to lift the packages from the plate 54.

The operator must press a control button on the control panel 68 (FIG. 1) on the canopy section 14 so that this, together with the cancellation of the operation of the micro-switch 62, causes depressurisation of the bag 52 and therefore complete lowering of the levers 48 and upper frame portion 44. When the frame portion has been fully lowered, the carriage 36 is retracted into the base section 12 of the revolver so as to leave the service gangway once again clear and to be ready for repetition of the doffing cycle after completion of the next set of packages. If the operator fails to clear the carriage in time, or forgets to return the carriage by pressing the return button, then the failure to return the carriage 36 will be registered by the winder control and suitable malfunction operation can be initiated, e.g. the machine can be shut down prior to or upon completion of winding of the next set of packages and an alarm can be sounded or registered at a central service console.

In FIG. 3, the micro-switch 62 and the expandable bag 52 are illustrated once again. The bag 52 expands against the dash pot 53 which is pressurized from the common air source 70 and ensures smooth working movements during raising and lowering of frame portion 44. Pressurisation of bag 52 is also effected from source 70 via line 72 which includes a pressure regulating valve 74, a main control valve 76 which will be further described below and a safety pressure relief valve 78. Line 72 is also connected to an exhaust valve 80 which is normally biased open as shown in FIG. 3 but which is closed in response to a signal S1 received from the main winder control and initiating the doffing cycle.

The main control valve 76 has associated therewith a pneumatic logic unit indicated within the square 82. This unit comprises two NAND gates N1, N2 respectively, two OR gates O1, O2 respectively and an AND gate A. On its first input 1, unit 82 receives the signal S1 initiating the doffer cycle, and this is fed to input a of NAND gate N1. On its second input 2, unit 82 receives a signal from the micro-switch 62; this is also the signal S1, but because the micro-switch 62 is normally biased open, as shown in FIG. 3, the signal S1 does not appear on input 2 of the logic unit until the micro-switch has been operated by depression of the plate 54 when it engages the packages. The signal on input 2 is fed to inbut b of the NAND gate N1 and to the OR gate O2. Each NAND gate N1, N2 is of the type which passes a signal on its input a to its output c unless a signal also appears on input b. A signal on the latter input is not passed to the gate output.

On input 3, unit 82 receives a signal from a micro-switch 84 which is mounted on the lower frame portion 42 of the carriage and is normally biased open as shown in FIG. 3, but is operated, when the lever 48 is fully lowered, to pass air pressure from the source 70 to input 3 on unit 82 and thence to both input b of NAND gate N2 and the AND gate A. The switch 84 thus acts as a sensor means for sensing movement of the upper frame portion 44 (and thus also the plate 54) into a fully lowered position. On input 4, unit 82 receives a signal S2 produced when the operator presses the return button on the control panel 82 after removing the packages from the carriage 36, as referred to above. This signal is passed to the AND gate A. On input 5, unit 82 receives a signal from a micro-switch 86. Which functions as a sensor means for sensing movement of the carriage 36 into the extended position. The switch 86 is associated with a piston and cylinder unit which functions as a means for moving the carriage 36 into and out of the base 12 of the revolver. In FIG. 3, the piston of this unit is indicated at 88 and the cylinder at 90. The signal passed by the switch 86 to input 5 is the starting signal S1, but because switch 86 is normally biased open as shown in FIG. 3, no signal appears on input 5 until the switch has been operated by the piston 88 when the carriage 36 has reached the fully extended position shown in the lefthand half of FIG. 2. The signal on input 5 is passed to both OR gates.

Unit 82 also has a first output 1 receiving any signal which passes the NAND gate N2. This is passed by a micro-switch 92 to the inboard chamber 94 of cylinder 90 to cause outward movement of the carriage 36. Switch 92 is normally biased shut as shown in FIG. 3 and is mounted on the front end of lower frame portion 42 of the carriage adjacent the contact plate 96 which is normally held clear of the switch by a compression spring 98 (FIG. 2) but which can be pressed back to open switch 92 if the plate engages an obstruction during outward movement of the carriage. The outward movement will cease promptly. The switch 91 thus also functions as a sensor means for sensing an obstruction to the movement of the carriage 36 into the extended position by disabling the piston and cylinder unit. The second output 2 from unit 82 receives any signal passed by AND gate A and passes this to the outboard chamber 100 of the cylinder 90, to cause retraction of the carriage 36.

Figure 4:
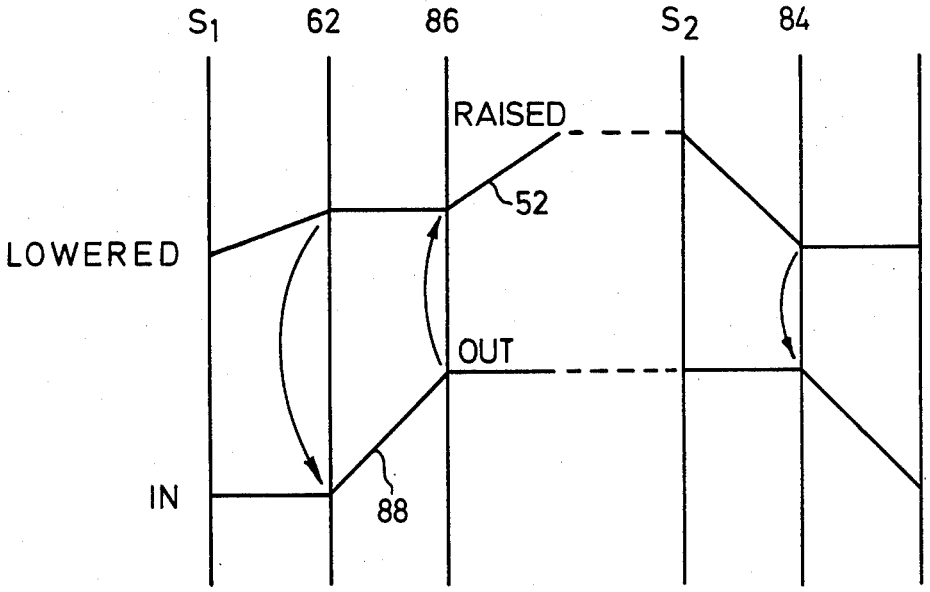
FIG. 4 is a timing diagram for use as an explanation of the circuit of FIG. 3.

The operation of the doffing control circuit will now be described in conjunction with the timing diagram shown in FIG. 4. The upper part of that diagram represents operation of the bag 52 during a normal doffing cycle and the lower part of the diagram indicates corresponding operation of the piston 88 of the carriage extension/retraction unit. The vertical lines indicate starting/termination of the various stages of the doffing cycle and the letters and numerals associated with vertical lines indicate the control element responsible for the transition from one stage to the next.

As described, at the start of a doffing cycle, carriage 36 is in the fully retracted, fully lowered position shown in FIG. 1 and in the right hand half of FIG. 2. Valve 76 is biased shut and valve 80 is biased open. Micro-switches 62 and 86 are biased open and micro-switch 84 is held closed against its bias because the lever 48 is in its lowermost position. In the following description, a normal doffing cycle is assumed, so that switch 92 is assumed closed throughout. When signal S1 is produced by the main winder control it is applied to input 1 of unit 82, it closes the exhaust valve 80 and is applied also to the micro-switches 62 and 86 where it is blocked because these switches are open. The signal on input 1 of unit 82 therefore passes gate N1 and gate O1 and opens the main control valve 76 against its normal bias. The bag 52 is therefore pressurized and begins to expand. Lever 48 rises switch 84 opens and the signal on input 3 of unit 82 is cancelled.

When plate 54 engages the packages, switch 62 applies the signal S1 to input 2 of unit 82. The signal on gate O1 is therefore cancelled and control valve 76 is again opened by its bias so that raising of frame portion 44 ceases. However, the signal on input 2 now passes the OR gate O2 and the NAND gate N2 and begins to move the piston 88 to the right in its cylinder 90 as viewed in FIG. 3, thereby extending the carriage 36. When the carriage is fully extended, it operates switch 86 so that signal S1 is applied by input 5 of unit 82 to both OR gates O1 and O2. The carriage is therefore held in its fully extended position, but valve 76 is once again opened to cause further raising of the frame portion 44 to raise the package through the distance H shown in FIG. 2. When the operator has removed both packages from the plate 54, micro-switch 62 will be open under its own bias, removing the signal from input 2 of unit 82. The carriage remains fully extended and fully raised and cannot return to the retracted position until the plate 54 is lowered to its fully lowered position.

However, when the operator presses the return button, the signal S2 is applied to input 4 of the unit 82 and the signal S1 is simultaneously cancelled. Valve 80 now returns to its open position under its own bias, the bag 52 is evacuated and the frame 44 and levers 46, 48 begin to sink under the pressure applied to them by the dashpot 53. The carriage is still held in its fully extended position, however, because at this stage signal S2 on input 4 of unit 82 cannot pass the AND gate due to the absence of a signal on input 3 of the logic unit. When lever 48 is fully lowered, however, switch 84 is closed against its bias and the necessary signal is applied to input 3 to enable appearance of an output signal on output 2 of the logic unit and therefore return of the piston 88 and carriage 36.

It will be seen therefore, that the illustrated revolver performs the basic function required of it, namely automatic doffing of full packages followed by lifting of those packages to a convenient working height to enable relatively easy removal by an operator. It will be understood that the chucks can be designed to carry any number of packages; e.g. there may be only one package extending substantially the full length of the chuck, or there may be more than the two packages illustrated in the drawings. Where there are a plurality of packages, they are removed simultaneously in a single doffing movement but they are in contact throughout this movement with a receiving surface, so that there is no danger of damage to the external windings (particularly at corners of the packages) as the packages leave the chuck support. The raisability and lowerability of the package receiving surface, together with the use of the sensor to indicate contact of that surface with the packages, provides another substantial advantage in that the same system is capable of dealing with packages of varying diameter. In addition, the system is capable of doffing bobbins from a chuck in the doffing position even when there has been machine malfunction so that each bobbin carries an incomplete package; such a package might consist of only a few layers of windings so that the effective package diameter is substantially the same as that of the bobbin tube 22. Such a malfunction will merely require additional raising of the package receiving surface 54 to enable operation of the micro-switch 62.

A machine of the type illustrated has been operated successfully when used to wind four packages, each approximately 30 cm in diameter and weighing about 7 kg, and also to wind two packages of the same diameter and each weighing about 14–15 kg. In the doffing position (30*a*, FIG. 1) the height of the package axis above the support surface of the winder is approximately 29 cm and the carriage 36 is set to raise the package axes through a distance H of approximately 30 cm after they have been moved into the service gangway. These figures are cited by way of example only, and they are in no way limiting upon the scope of the invention.

What is claimed is:

1. A winding machine comprising at least one chuck;

a doffing carriage for doffing at least one filament package from said chuck;

first moving means for moving said carriage between a retracted position beneath said chuck and an extended position spaced from said chuck;

a package-receiving member on said doffing carriage;

second moving means for raising and lowering said package-receiving member;

first sensor means for sensing contact of said member with a package on said chuck; and second sensor means for sensing movement of said carriage into said extended position;

said first and second sensor means being operatively connected to said first and second moving means whereby said first sensor means de-activates said second moving means to cease raising said member in response to said member contacting a package with said carriage in said retracted position and then activates said first moving means to move said carriage towards said extended position and with said receiving member maintained by said second moving means in contact with said package, and said second sensor means re-activates said second moving means to raise said member in response to said carriage reaching said extended position.

2. A winding machine as claimed in claim 1, further comprising at least two chucks movable successively from a winding position to a doffing position, said retracted position of said doffing carriage lying beneath said doffing position whereby said package-receiving member is adapted to receive and support packages doffed from a chuck in said doffing position.

3. A winding machine as claimed in claim 2 wherein said carriage has a doffer member to engage a bobbin on a chuck in said doffing position, and to move the bobbin off the chuck as said carriage is moved from said retracted to said extended position.

4. A winding machine as claimed in claim 2 further comprising means for producing a signal when a chuck moves into said doffing position, said second moving means being activated in response to said signal to raise said package-receiving member.

5. A winding machine as claimed in claim 1 wherein said package-receiving member has a fully-lowered position relative to said carriage, and which further comprises third sensor means for sensing movement of said member into said fully-lowered position, said third sensor means being operatively connected to said first moving means whereby said first moving means cannot return said carriage from said extended to said retracted position until said package-receiving member is in said fully lowered position.

6. A winding machine as claimed in claim 5 further comprising manually operable means for de-activating said second moving means to lower said package-receiving member into said fully-lowered position while said carriage is located in said extended position.

7. A winding machine as claimed in claim 1 further comprising an additional sensor means for sensing an obstruction to movement of said carriage into said extended position, said additional sensor means being operatively connected to said first moving means to disable said first moving means in response to sensing of an obstruction.

* * * * *